United States Patent [19]

Hoyt

[11] Patent Number: 4,628,853

[45] Date of Patent: Dec. 16, 1986

[54] RECREATIONAL WATERCRAFT

[76] Inventor: John G. Hoyt, 1 Harbor View Dr., Newport, R.I. 02840

[21] Appl. No.: 740,188

[22] Filed: May 31, 1985

[51] Int. Cl.[4] ..... B63B 1/16

[52] U.S. Cl. ..... 114/274; 114/39; 441/68

[58] Field of Search ..... 114/39.1, 39.2, 271, 114/274, 283, 275; D12/314, 311, 313; 441/65, 68, 72, 73, 75

[56] References Cited

U.S. PATENT DOCUMENTS

| | | | |
|---|---|---|---|
| 764,741 | 7/1904 | Manker | 114/274 |
| 2,738,525 | 3/1956 | Roberts | 441/72 |
| 2,917,016 | 12/1959 | Schertel | 114/274 |
| 3,164,119 | 1/1965 | Emmanuel et al. | 114/274 |
| 3,216,031 | 11/1965 | Ingold, Jr. | 441/68 |
| 3,456,611 | 7/1969 | Johnson | 114/275 |
| 3,487,800 | 1/1970 | Schweitzer et al. | 114/102 |
| 3,570,444 | 3/1971 | Farr | 114/270 |
| 3,807,333 | 4/1974 | Ross | 114/39.1 |
| 4,048,939 | 9/1977 | Jones, Jr. | 114/274 |

*Primary Examiner*—Galen L. Barefoot
*Assistant Examiner*—Edwin L. Swinehart
*Attorney, Agent, or Firm*—Barlow & Barlow, Ltd.

[57] ABSTRACT

A watercraft has a hull that is further supported above the surface while underway by a ski and integral hydrofoil, the hydrofoil is semicircular and is affixed to the hull and ski.

5 Claims, 8 Drawing Figures

RECREATIONAL WATERCRAFT

BACKGROUND OF INVENTION

Sailboards such as are exemplified in the U.S. Pat. No. 3,487,800 have become a very popular recreational item. In essence, the sailboard consists of a unit such as a surfboard or the like that has some means provided for lateral stability and to which a sail has been provided on a mast that is connected to the board by means of a universal joint.

One of the great enjoyments of a sailboard is the speed that is attained. For example, it is not uncommon with a wind velocity in the vicinity of 20 knots for the vehicle to attain speeds in the vicinity of 12 to 14 knots. If additional speed is desired, one of the solutions is to reduce the wetted surface.

Hydrofoils have been proven effective on vessels that are propelled by motors since the motor provides a strong and controllable thrust. The same is not true on sailboats where the power source which is wind is more variable. When hydrofoils have been used on sailboats they have been employed in the bow and the stern consisting of athwartships foils supported by struts below the hull, see for example the Steinberg U.S. Pat. No. 3,373,710. This arrangement works well with engine power but the excessive underwater drag of the struts and the foils proves too much for sail power to overcome, particularly in light winds. In addition the variable nature of the wind power often leads to a condition known as "porpoising" where the lead foil loses lift suddenly causing the bow to plunge and rise erratically.

Hydrofoils have been successful on large power passenger and military boats, but their use requires large engines and skilled operation.

Ski structures have been used on power recreational watercraft, as for example, as seen in U.S. Pat. No. 2,817,101. In this form they do not have complete stability and are subject to "porpoising and pounding" in rough seas.

SUMMARY OF THE INVENTION

The present invention provides a watercraft that adds a new dimension to sailboard sailing or powerboating with enhanced speed and reduced pounding. The sailboard is provided with the usual mast mounted on a universal joint with a sail affixed thereto and underneath the body of the sailboard there is provided a longitudinal ski. The ski is provided with a single hydrofoil so that the effect is the combination of a planing action lift of the longitudinal ski with a hydrodynamic lift of the hydrofoil as well as a smooth decent for the sailboard or powerboat to settle back into the water at lower speeds. The hydrofoil is preferably made of semicircular design to provide an automatic heeling correction through the lift forces that operate at right angles to the foil. In the powerboat version, the hydrofoil is shown mounted more centrally of the boat hull while the motor power, illustrated in the form of an outboard, is mounted at the stern of the powerboat hull. In all cases the hydrofoil serves as a support for the ski.

DESCRIPTION OF THE PREFERRED EMBODIMENTS

Figure 1:
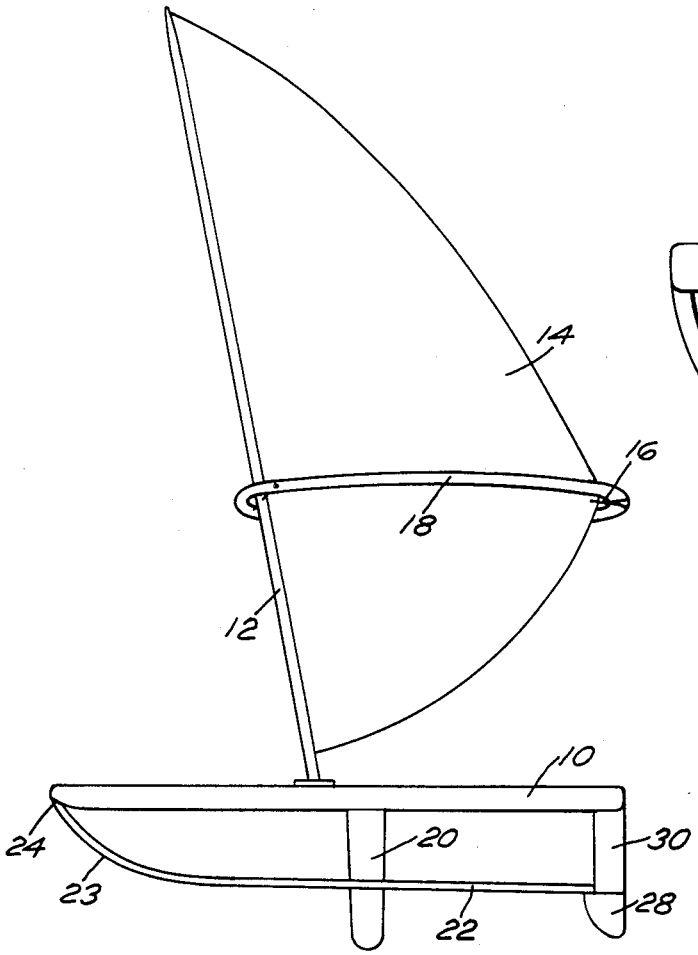
FIG. 1 is a elevational view of a sailboard made in accordance with the invention.
Figure 2:
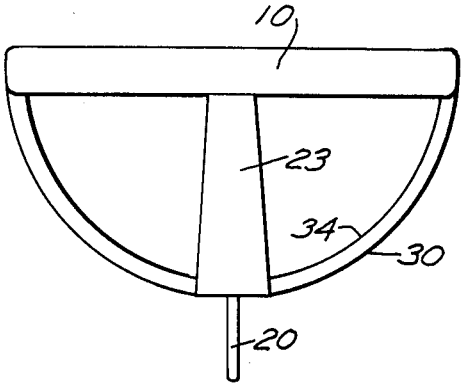
FIG. 2 is a front view thereof on a larger scale with the sail and the mast omitted.

Referring to FIGS. 1-5 of the drawings, the watercraft apparatus includes a hull in the form of a board 10, a mast 12, upon which there is mounted a sail 14 of modified triangular shape. The clew of the sail is held extended away from the mast as at 16 by a wishbone boom structure 18. The board is provided with a dagger board 20 that is inserted through an opening, not shown, provided in the body of the board 10.

A central ski 22 has an upwardly curved forward end 23 which is attached to the sailboard as at 24. The runner portion of the ski 22 is provided with an aperture 26 through which the dagger board 20 extends and at the rear end of the runner of the ski, there is mounted a stabilizing fin 28.

Figure 4:
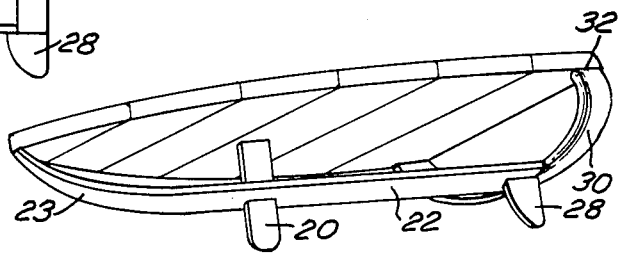
FIG. 4 is a perspective view taken from the underside.
Figure 3:
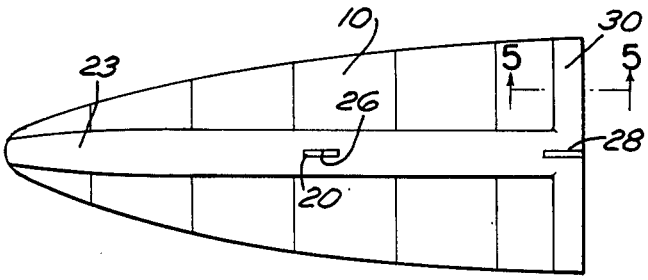
FIG. 3 is a bottom view thereof.
Figure 5:
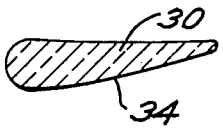
FIG. 5 is a sectional view on line 5—5 of FIG. 3.

The rear end of the runner of the ski 22 connects with a semicircular hydrofoil structure 30 which is affixed to the rear end of the sailboard, as for example at 32, and is made integral with the rear end of the runner of the ski as seen more particularly in FIGS. 3 and 4. The position of the hydrofoil may be varied longitudinally to some degree, so long as the foil is maintained near the center of gravity of a loaded craft. The hydrofoil has the usual section as seen in FIG. 5, lift being created by the curved upper surface 34.

Figure 6:
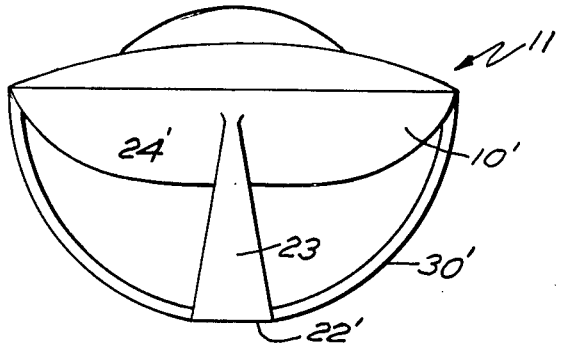
FIG. 6 is a side elevational view of a slightly modified embodiment for a powerboat made in accordance with the invention.

Referring now to FIG. 6, the powerboat version of the invention is illustrated as consisting of a hull 10' which has a cockpit in the area designated generally by the reference numeral 11, the hull being formed so that the same has sufficient displacement to support the load of occupants as well as a source of motor power. To the hull there may be attached at the stern thereof a motor 15 which is illustrated in the form of a outboard. To the underside of the hull, there is affixed by means of struts 21, 21 a, a ski 22' has an upwardly curved forward end 23 that is preferably attached to the bow of the hull 10' as at 24'.

Figure 7:
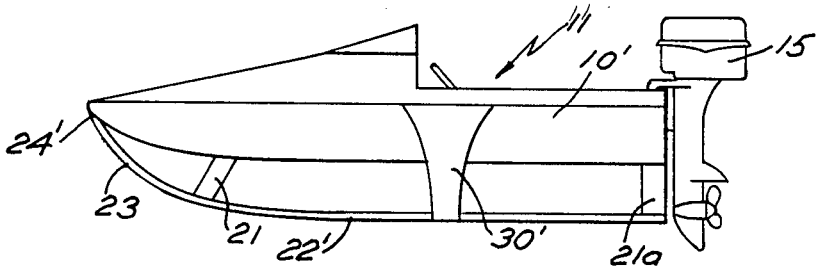
FIG. 7 is a front view thereof.
Figure 8:
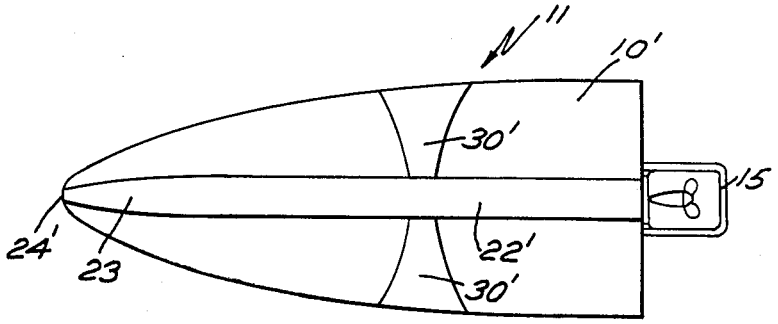
FIG. 8 is a bottom view thereof.

A semicircular or arcuate hydrofoil structure, 30' is affixed to the side of the hull 10' and, as seen in FIG. 7, extends from its point of attachment to meet with the ski 22' where it is made integral therewith and then continues on up to the other side of the boat hull 10'. In this fashion the hydrofoil acts as a support for the ski. It will also be noted that the cross section of the foil is greater at the point of attachment. This feature can add buoyancy in the static position.

In use, it will become apparent that the wetted surface area of the sailboard or powerboat is reduced which will reduce the drag. Further, the frontal area of the underwater surface with a longitudinal ski with its upturned front end will initially, as the speed of the sailboard or powerboat increases, tend to create a planing action and lift the board out of the water. This will also be assisted by the secondary lift of the hydrofoil 30. Essentially, the ski will keep the nose of sailboard or powerboat out of the water and this combined with the continuous length of the runner of the ski will provide fore and aft stability at all times. Lateral stability necessary for sailing is formed by the dagger board 20 and the stabilizing fin 28. The semicircular design of the athwartships hydrofoil makes an automatic heeling correction through lift forces that operate at right angles to the foil. Thus, the continuous length of the athwartships hydrofoil provides sidewards stability. Once the watercraft has been lifted out of the water with the use of the ski that first forces the bow up aided by the lifting action of the hydrofoil, any tendency of the sailboard or powerboat to heel will be corrected by the lift action of the foil, but the sailboard will stay substantially a horizontal plane with a longitudinal ski providing planing, lift and fore and aft stability, while the foil provides hydrodynamic lift and sideways stability which will enable the watercraft to balance on a single ski.

The hydrofoil 30 may be made of a polyurethane foam covered with resin impregnated glass cloth or metal and a similar structure can be provided for the ski 22. The watercraft hull itself may also be made of a foam covered resin impregnated glass cloth, and the powerboat hull of a fiberglass form, all of which is very standard in the marine industry today.

I claim:

1. A watercraft having a hull, a ski structure mounted beneath the hull; said ski having a substantially flat section with an upwardly curved frontal portion secured to one end of the hull and a runner portion spaced from the hull whereby with forward motion a planing action with lift the watercraft; means extending transversely of the hull including a hydrofoil attached at each end thereof to the hull and affixed centrally to said runner portion to maintain the lift of the watercraft and support the runner portion of the ski in spaced relation to hull.

2. A watercraft as in claim 1 wherein the hydrofoil is of arcuate shape and of foil section.

3. A watercraft as in claim 1 wherein the hydrofoil has an enlarged foil section at each side of the hull.

4. A watercraft as in claim 1 wherein the hydrofoil of arcuate shape and of foil section is affixed to the rearward end of the runner transversely of the hull.

5. A watercraft having a hull, a ski structure mounted beneath the hull, said ski having a substantially flat section with an upwardly curved frontal portion secured to one end of the hull and a runner portion spaced from the hull, arcuate hydrofoil sections affixed to the runner transversely of the hull, one section extending from the ski and affixed to one side of the hull and the other section extending from the ski and affixed to the other side of the hull whereby the ski is supported in spaced relation to the hull.

* * * * *